US005651355A

United States Patent [19]

Gallops, Jr.

[11] Patent Number: 5,651,355

[45] Date of Patent: Jul. 29, 1997

[54] INSIDE MOUNTED SLIDING TWO-PIECE STAGGERED SLOTS CABLE GUARD

[75] Inventor: Henry M. Gallops, Jr., Gainesville, Fla.

[73] Assignee: Bear Archery, Inc., Gainesville, Fla.

[21] Appl. No.: 509,377

[22] Filed: Jul. 31, 1995

[51] Int. Cl.[6] ..... F41B 5/10

[52] U.S. Cl. ..... 124/25.6; 124/86

[58] Field of Search ..... 124/23.1, 25.6, 124/86, 88

[56] References Cited

U.S. PATENT DOCUMENTS 4,886,038 12/1989 Betters ..... 124/25.6

4,903,678 2/1990 Walker ..... 124/25.6 X 4,917,070 4/1990 Townsend ..... 124/25.6 X 4,919,108 4/1990 Larson ..... 124/88

5,161,514 11/1992 Cary ..... 124/25.6 X

*Primary Examiner*—John A. Ricci

*Attorney, Agent, or Firm*—Malina & Wolson

[57] ABSTRACT

A cable guard assembly is disclosed for use with a compound archery bow which comprises discrete cable retainers that are separately slidable on a cable rod. The cable retainers are of different lengths and the cable rod is located within noncircular openings in the cable retainers. A resilient circular element is provided on the rod between the cable retainers for noise reduction.

13 Claims, 2 Drawing Sheets

INSIDE MOUNTED SLIDING TWO-PIECE STAGGERED SLOTS CABLE GUARD

This invention relates to compound archery bows and particularly to an improved cable guard for use thereon, for maintaining the required lateral spacing of the cables from the bowstring to permit free passage of an arrow.

BACKGROUND OF THE INVENTION

Cable guards are utilized in compound archery bows when the cables and bow strings are too closely spaced laterally to permit the free passage of an arrow. U.S. Pat. No. 4,452,222 discloses a cable guard including a cable retaining member which is rotatably and slidably mounted on a round rod. The retaining member has two bores therein which slidably receive the cables to hold them in laterally spaced relationship with the bowstring.

When the bow is being drawn, the two cables in the bores are urged in opposite direction with each cable rubbing against its respective bore. The undesirable contact of the moving cable with the bores creates frictional forces on the cable and attendant cable wear. In addition, the bores in the retaining member and the cables therein are located in a plane that is parallel to the plane of the bowstring. During draw, the cables move in opposite vertical directions with respect to each other, and because the cables are in the same plane, they have a tendency to rub against each other again producing undesirable frictional forces and cable wear.

Further, the lateral opening in the retaining member which slidably receives the round rod is circular and therefore permits only limited movement of the retaining member with respect to the rod. It is desirable, however, that there be some play between the retaining member and the rod so that the retaining member does not urge the cables into a stressed position.

OBJECT OF THE INVENTION

An object of the invention is to provide an improved cable guard in which the contact between the cables and the cable retaining means is reduced when the bow is being drawn.

A further object is to provide an improved cable guard in which the cables are not in the same plane.

A still further object is to provide an improved cable guard which enables increased freedom between the cable retaining means and the rod on which it is mounted.

Further objects and advantages will appear from the following description when read in connection with the accompanying drawing.

BRIEF DESCRIPTION OF THE DRAWING

A better understanding of the present invention will be had with reference to the following detailed description when read in conjunction with the accompanying drawing wherein like reference characters refer to like parts throughout the several views, and in which.

DESCRIPTION OF A PREFERRED FORM OF THE INVENTION

Figure 1:
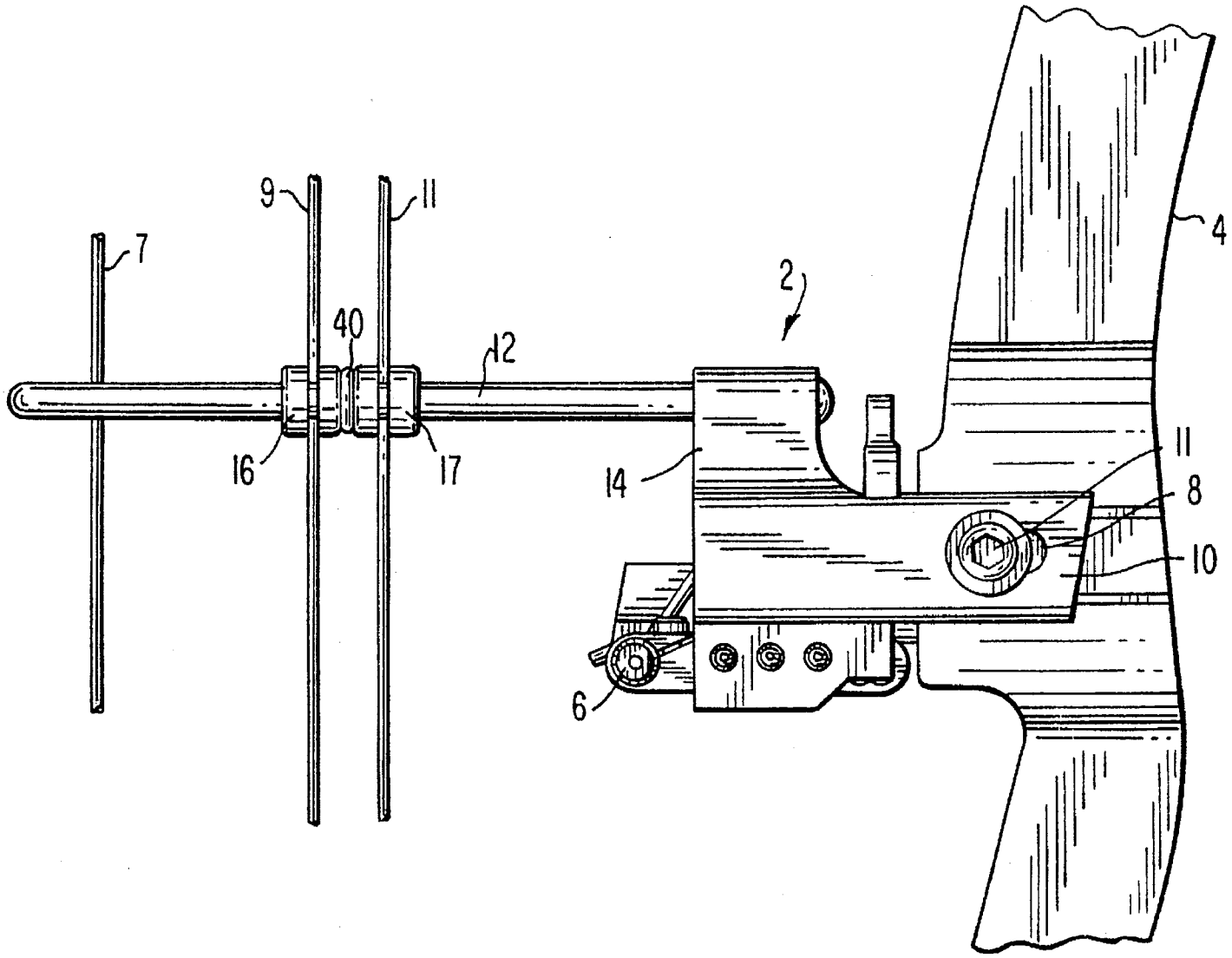
FIG. 1 is a partial side elevational view of the cable guard assembly of the present invention attached to an archery bow handle.
Figure 2:
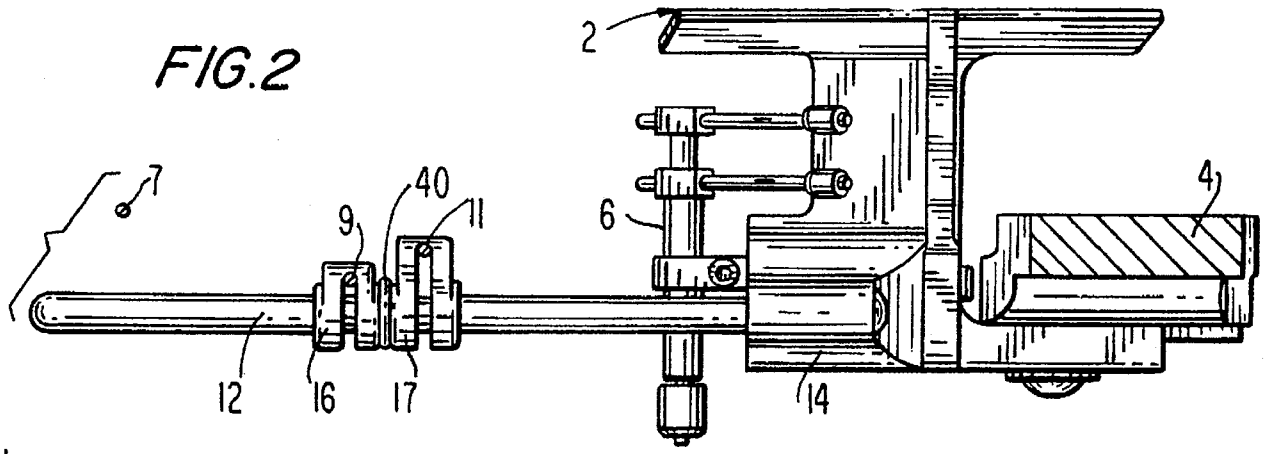
FIG. 2 is a top view of the cable guard of the present invention.
Figure 4:
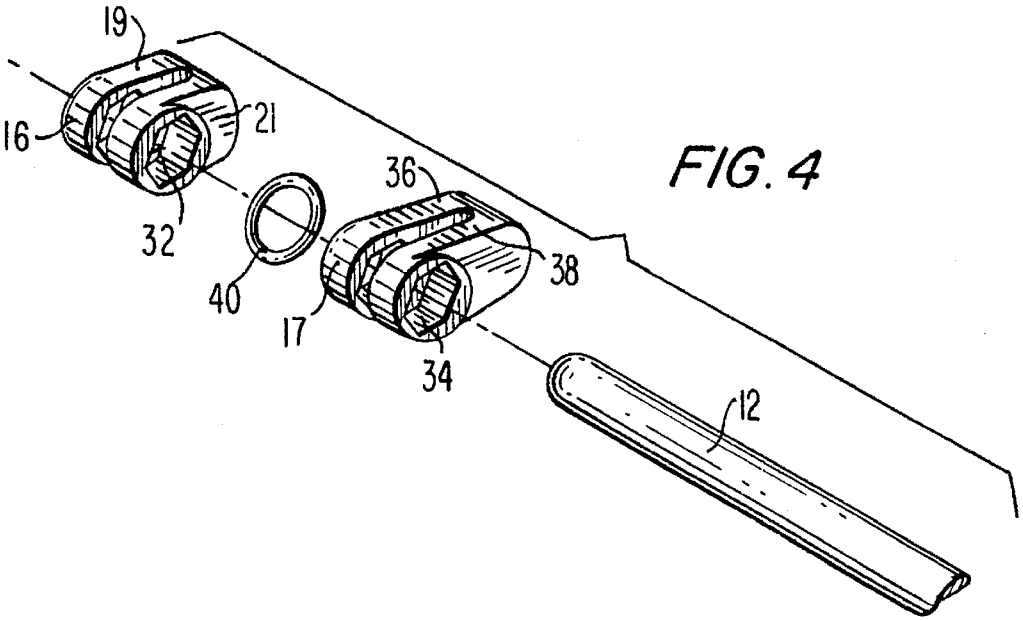
FIG. 4 is a perspective view of the cable retaining member of the cable guard assembly.
Figure 3:
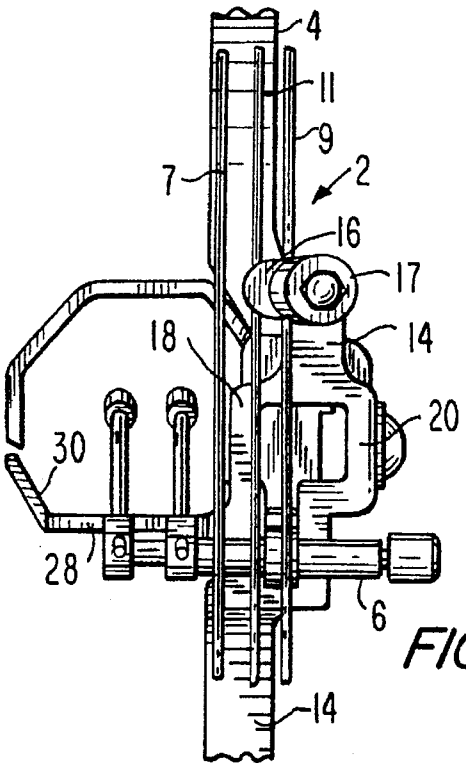
FIG. 3 is a partial elevational view of the cable guard assembly of the present invention as viewed by an archer.

Referring to the drawings, a cable guard assembly 2 is disclosed which is adopted for mounting on the inner face of a compound archery bow handle 4. A conventional arrow rest 6 is mounted on cable guard assembly 2. A bowstring 7 and cables 9 and 11 are shown in their position relative to each other and to the handle 4 when the bow is in the braced position. The cables and bowstring assembly of a conventional compound bow extend over eccentric wheels or pulleys attached to the outer ends of the bow limbs. The cables 9 and 11 are spaced laterally from the bowstring 7.

Cable guard assembly 2 includes a channel opening 8 in a rear section 10. A cap screw 11 is inserted in channel opening 8 of cable guard assembly 2 and into an opening in archery bow handle 4 for connecting cable guard assembly 2 to archery bow handle 4. The channel opening 8 of cable guard assembly 2 allows the assembly 2 to be moved perpendicularly with respect to the axis of the archery bow handle 4 for adjustment of the cable guard assembly with respect to the handle. The cable guard assembly 2 includes a round rod 12 which extends from a top section 14 of cable guard assembly 2 and is parallel to the plane of the bowstring 7 and is perpendicular to the vertical axis of the archery bow handle 4. Side sections 18 and 20 of cable guard assembly 2 are integral with top section 14. Bottom section 28 of cable guard assembly 2 is integral with inclined wall 30.

Rod 12 is spaced laterally from the bowstring 7 and cables 9 and 11. Cable retaining means 16 and 17 slidably mounted on rod 12 hold the cables 9 and 11, respectively, in lateral spaced relationship with the bowstring 7 to assure free passage of an arrow. A circular resilient ring 40 is slidably mounted on rod 12 and is positioned between cable retaining means 16 and 17 for noise prevention purposes. Cable retaining means 16 is U-shaped and has hexagonally-shaped openings 32 in the sides 19 and 21 of the cable retaining means 16. Rod 12 extends through openings 32 in sides 19 and 21. Cable 9 is maintained in position between rod 12 and the U-shaped portion of cable retaining means 16. Cable retaining means 17 is also U-shaped and has hexagonally-shaped openings 34 in the sides 36 and 38 of cable retaining means 17. Rod 12 extends through openings 34 in the sides 36 and 38, and cable 11 is maintained between rod 12 and the U-shaped section of cable retaining means 17. Cable retaining means 16 is substantially identical to cable retaining means 17 except that the sides 19 and 21 of cable retaining means 16 are shorter than the sides 36 and 38 of cable retaining means 17.

As noted above, the prior art cable retaining means consisted of a single element in which both cables were located in their respective bores. As a result, when the bow was drawn, the two cables in the bores were urged in opposite directions against their respective bores. The undesirable contact of the moving cables with the bores created frictional forces on the cable and attendant cable wear. In accordance with the present invention, by providing discrete retaining elements 16 and 17, which are separately slidable along rod 12, the cables 9 and 11 located in the elements, move more freely within retaining elements 16 and 17 so that less frictional forces are produced on the cables. As also noted above in the discussion of the prior art, when the cables are in the same plane, there is a tendency of the cables to rub against each other and produce frictional forces on the cables. In the present invention, because the retaining means 16 and 17 are of different lengths, the cables, located in said retaining means, are in different planes and there is less tendency of the cables to rub against each other. It was also noted that the circular opening in the retaining means of the prior art limited the play between the round rod and the retaining means. The hexagonal openings in the retaining means of the present invention permits more play between the rod and the retaining means and there is less tendency for the cables to urge the retaining means into a stressed position.

Having described my invention, however, many modifications thereto will become apparent to those skilled in the art to which it pertains without deviation from the scope of the invention as defined by the scope of the appended claims.

What I claim is:

1. A compound archery bow having a handle, a bowstring, a pair of cables, and an improved cable guard comprising a rod having two separate independently moveable cable retaining means thereon and wherein the cable retaining means are not rotatable.

2. A compound archery bow having an improved cable guard as set forth in claim 1, wherein a resilient circular member is mounted on the rod between said retaining means.

3. A compound archery bow having an improved cable guard as set forth in claim 1 wherein the retaining means are U-shaped and wherein the cables are retained between the U-shaped portion of the retaining means and the rod.

4. A compound archery bow having an improved cable guard as set forth in claim 1, wherein the cable retaining means have openings therein for receiving the rod.

5. A compound archery bow having an improved cable guard as set forth in claim 4, wherein the openings in the cable retaining means for receiving the rod are hexogonally shaped.

6. A compound archery bow having an improved cable guard as set forth in claim 5, wherein the rod is round.

7. A compound archery bow having an improved cable guard as set forth in claim 1 including noncircular openings in the cable retaining means for receiving the rod.

8. A compound archery bow having an improved cable guard as set forth in claim 1, wherein said cable retaining means are of different lengths.

9. A compound archery bow having an improved cable guard as set forth in claim 8, wherein a resilient circular member is mounted on said rod between said retaining means.

10. A compound archery bow having an improved cable guard as set forth in claim 9 hexagonally shaped openings in the cable retaining means for receiving the rod.

11. A compound archery bow having an improved cable guard as set forth in claim 10, wherein the rod is round.

12. A compound archery bow having an improved cable guard as set forth in claim 8, wherein the retaining means are U-shaped and wherein the cables are retained between the U-shaped portion of the retaining means and the rod.

13. A compound archery bow having an improved cable guard as set forth in claim 8 including noncircular openings in the cable retaining means for receiving the rod.

* * * * *